US005634175A

United States Patent [19]

Michlin et al.

[11] Patent Number: 5,634,175

[45] Date of Patent: May 27, 1997

[54] ELECTRICAL CONTACT DEVICE FOR DEVELOPER ROLLER OF TONER CARTRIDGE

[75] Inventors: Steven Bruce Michlin, 5310 Bentley Ste. 105, West Bloomfield, Mich. 48322; Randall F. Sell, Pontiac, Mich.

[73] Assignee: Steven Bruce Michlin, West Bloomfield, Mich.

[21] Appl. No.: 411,934

[22] Filed: Mar. 28, 1995

[51] Int. Cl.[6] ..... G03G 15/06; G03G 21/00

[52] U.S. Cl. ..... 399/90; 399/279

[58] Field of Search ..... 355/200, 210, 355/211, 212, 245; 399/90, 265, 279

[56] References Cited

U.S. PATENT DOCUMENTS

| | | | |
|---|---|---|---|
| 4,003,650 | 1/1977 | Courtney et al. | 355/245 |
| 4,839,690 | 6/1989 | Onoda et al. | 355/211 |
| 4,951,599 | 8/1990 | Damji | 355/200 X |
| 5,128,715 | 7/1992 | Furuyama et al. | 355/200 |
| 5,339,133 | 8/1994 | Otomo et al. | 355/200 |
| 5,357,321 | 10/1994 | Stenzel et al. | 355/211 |
| 5,402,207 | 3/1995 | Michlin | 355/200 |
| 5,446,525 | 8/1995 | Kobayashi | 355/210 |

*Primary Examiner*—Fred L. Braun

[57] ABSTRACT

A developer roller contact device that provides a more reliable and longer lasting electrical connection between a bias voltage source and a developer roller of a toner cartridge assembly used in printers, copiers and facsimile machines. In the first embodiment, an improved contact device has been developed that has a conductive cylindrical member with a rim on one end. The cylindrical member is sized to fit snugly within the developer roller to contact the inner wall of the roller. The rim abuts against the end of the developer roller to hold the contact device in position. A contact surface provided inside the cylindrical member presses against the electrical contact mounted on the cartridge assembly. A second embodiment of the contact device is for a different type of cartridge assembly. The cylindrical member is divided into a large diameter portion for snugly fitting within the developer roller and a small diameter portion for fitting within an alignment piece on the cartridge assembly. A coil spring is held under tight pressure or compression between the end of the small diameter portion and the electrical contact mounted on the cartridge assembly. The coil spring completes the electrical connection between the contact device and the bias voltage source.

28 Claims, 11 Drawing Sheets

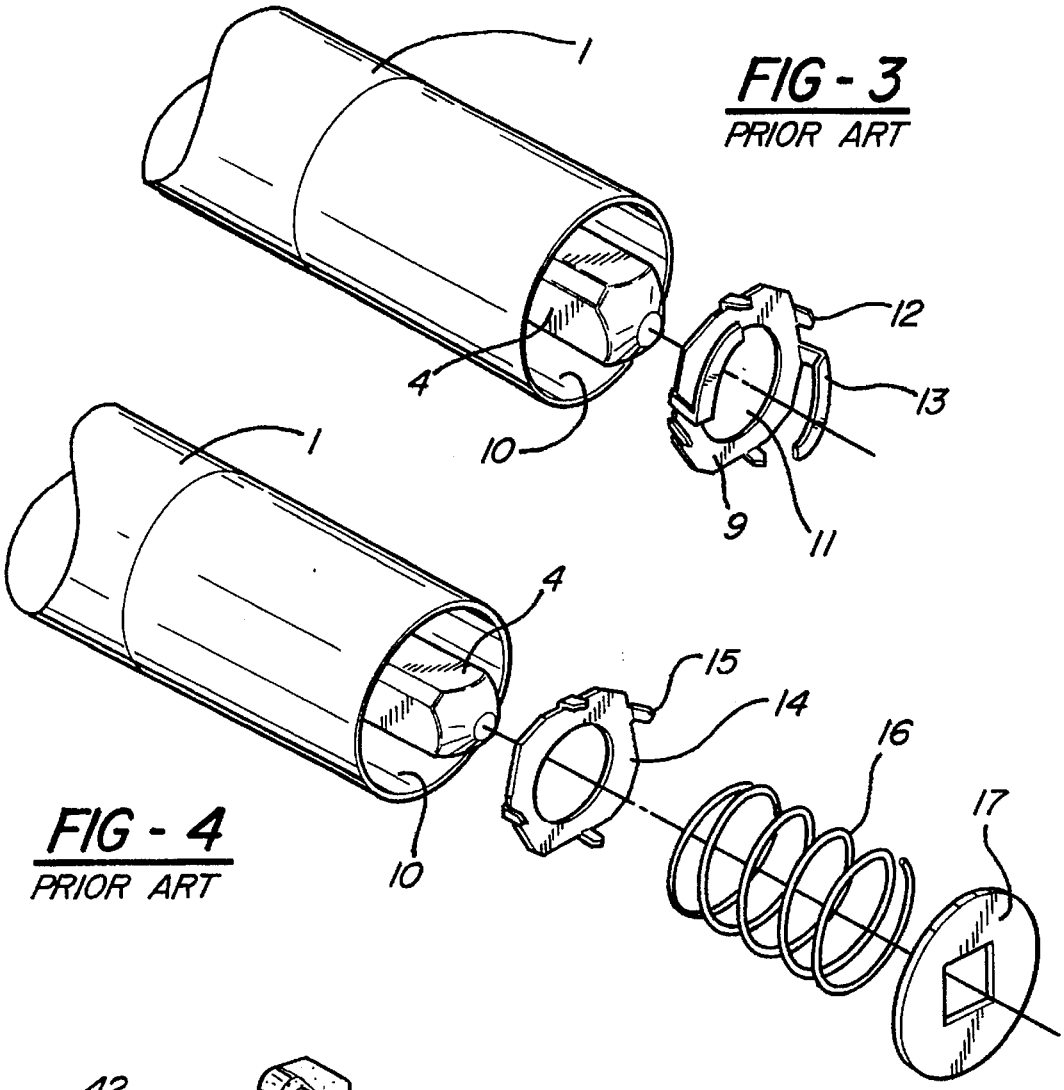
FIG - 3
PRIOR ART
FIG - 4
PRIOR ART
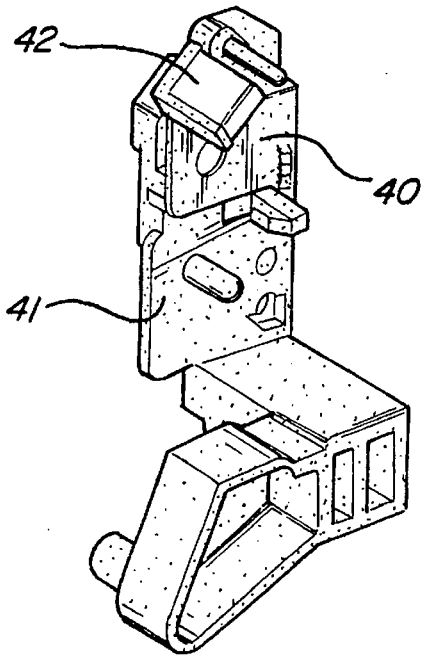
FIG - 9a
PRIOR ART

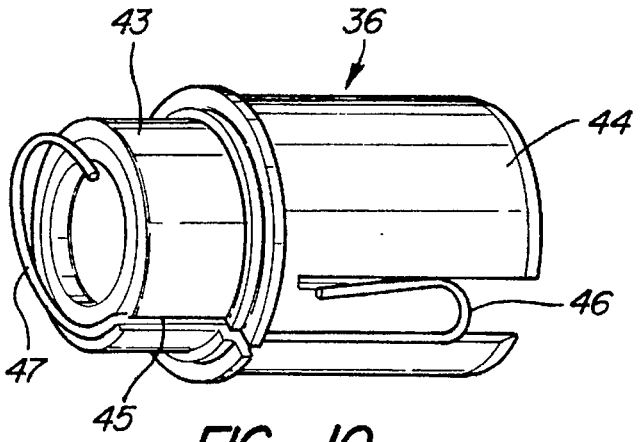
FIG - 10
PRIOR ART
FIG - 11
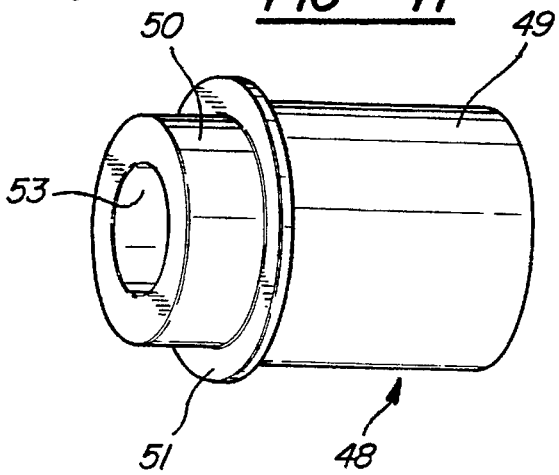
FIG - 12
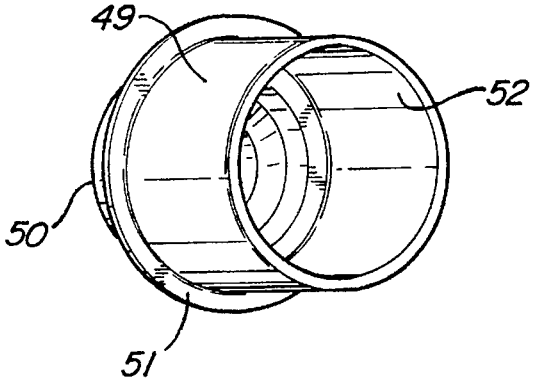
FIG - 13
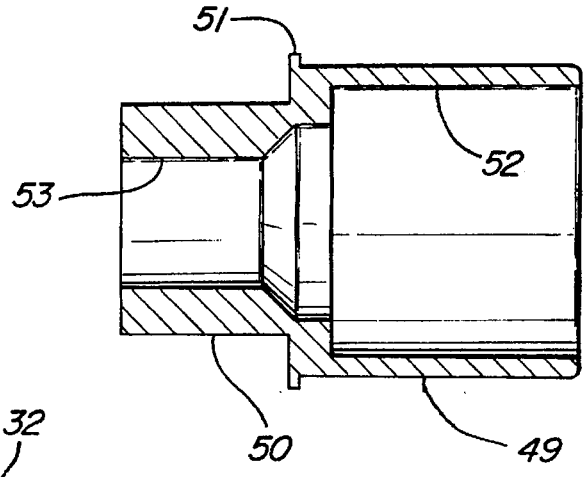
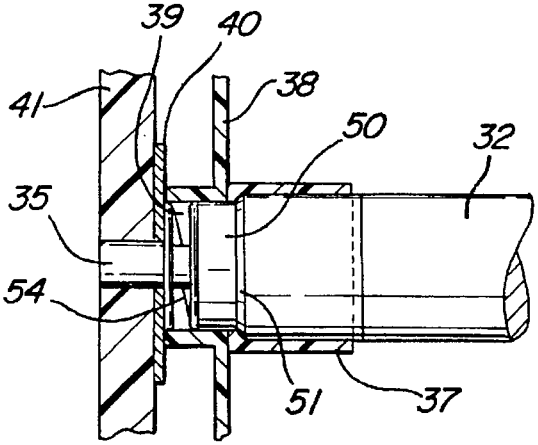
FIG - 14

ELECTRICAL CONTACT DEVICE FOR DEVELOPER ROLLER OF TONER CARTRIDGE

BACKGROUND OF THE INVENTION

This invention relates to improving the reliability of the electrical connection between developer rollers and imaging devices in toner cartridges as used in Xerography and more specifically in the toner cartridge remanufacturing industry. These imaging devices include copiers, laser printers and facsimile machines. Some imaging devices do use removable toner cartridges and others do not. Although, the devices discussed involve the toner hopper assembly of the toner cartridge, imaging devices that do not use toner cartridges have toner hopper assemblies and may thus use the embodiments of this invention, even though only specific models of imaging devices are discussed that do use toner cartridges.

CANON has designed an all-in-one cartridge as in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1995 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartrides with longer cycles, so component improvements are significant. Therefore, avoiding natural problems with prevention means must also be implemented for cartridges of longer life both in longer cycle times and greater number of cycles. Developer rollers and related components are no exception. They do not last indefinitely although there are some things that may be done to increase the life expectancy.

First, the most often seen developer roller contact has been a copper alloy helical spring to supply a bias voltage to the inside wall of the developer roller. Many developer rollers have a magnetic core. The rotating helical spring is in constant contact with a stationary stainless steel washer. As the developer roller rotates, the helical spring is always in contact with the stainless steel washer. The washer provides it with the bias voltage connection supplied by the printer's electronic circuitry. However, on a random basis, more frequently than desired, this connection between the stainless steel washer and the helical spring loses its integrity. It wears. It loses its spring force. The spring may be bent back to its original "design" position, but it is a fairly time consuming task to bend it back out and even more difficult to obtain the correct bend. Both the spring and washer may obtain deposits of insulative toner, or oxidation from the spring copper of the helical spring. Even a speck of insulative debris is enough to ruin the integrity of this connection. Since it rotates, the connection must be thought of as a connection for 360 degrees of rotation. A little speck of discontinuity is all it takes to ruin what would have otherwise been a perfect image. With this system, there are many places where it can go wrong. For example, the location where the washer touches the source of the bias voltage. There is the connection where the helical spring rotates, touching the washer. The helical spring is part of an assembly that fits inside the developer roller. The assembly "bites" into the inner wall (usually aluminum) of the developer roller. It may eventually lose good contact at that point. Typically, these developer roller contacts bite into the inner wall in two or three small places. It may lose its connection integrity from the spring losing its original resiliency. However, whatever the reason the connection loses its integrity, it does not function the same as brand new over many cycles. Furthermore, the replacement components are not available from the OEM manufacturer. Consequently, remanufacturers have had to come up with their own solutions to this problem. Many Americans' livelihoods are at stake when you look at the size of the cartridge remanufacturing industry.

An inventor of this application introduced the first solution to the problem when he wrote an article over two years ago about using conductive grease in this assembly where the helical spring contacts the stainless steel washer (Recharger, February 1992, pg 95, "Tech Talk and New Ideas"). Others soon copied this idea and used other conductive greases. In the Summer of 1993 the debate began about which conductive greases are appropriate. There are two schools of conductive greases, very generally. The first type function well in practice, but by themselves do not conduct current as measured with a voltmeter or ohmeter. However, although this produced "miracle" results with customers, the effectiveness of the grease fell off near the end of the cartridge cycle when the grease was gone. Furthermore, to grease the helical spring area for every cartridge cycle is too labor intensive. After getting to the difficult to reach helical spring and stainless steel washer, reassembly of the developer roller is very time consuming. This was the first fix known for this problem. Among the symptoms of not fixing this problem are uneven darkness on the output page, uneven blacks, uneven gray shades, and unsolid blacks. By using the conductive grease, the problem goes away. However, it is cumbersome to apply. The inventors of this application have been searching for a better way.

The other conductive grease, used by some, is a black conductive grease. This grease, when measured with an ohmeter, has continuity at any distance. However, unlike the other described grease which wears away near the end of the cycle, the black grease cakes up or hardens before the end of the cartridge cycle. In conclusion, conductive greases were a good fix before other solutions came about.

A second improvement involves a spring inside the developer roller. In this development remanufacturers began by removing the helical spring assembly from inside the developer roller. They snipped off the helical portion, two helical prongs, from the helical spring assembly, placed the modified helical assembly back in the developer roller tube (no longer helical), and placed a coil spring between the assembly and the stainless washer. An inventor of this application used a steel piano wire coil-spring in this place. One company used a copper alloy coil spring. Another company replaced the spring assembly with a copper alloy assembly to receive the coil spring and added to it a copper alloy washer to replace the stainless steel washer which may be used as an addition to it. However, this product was practical for large customers for only one main reason. It was found that reliability was low until the user used the product for a while. Then cartridge technicians began using assembly jigs to accurately place either the original modified helical assembly or its replacement assembly into the developer roller. Since precision is important, some remanufacturers find this kind of product desirable and others find it too time consuming. Many do not have the patience to learn to use it correctly.

Another product that has come on the market is a clip for providing the bias voltage directly from the doctor blade to the developer roller, similar to the spring. The bias voltage is important for transporting toner from the developer roller to the photoreceptor drum. It is transported by two main forces. First, the photoreceptor drum has a charge on it for white space and a lack of or lesser charge where there is black image space. In other words, the charged surface of the photoreceptor drum repels toner while the uncharged pixels, where charge was removed by laser light, attract toner from the surface of the developer roller. The developer roller is continually ready to move toner to the photoreceptor drum in this selective fashion. However, the developer roller has a bias voltage that essentially in simplification repels toner to the photoreceptor drum and then having an alternating current component, attracts back whatever the photoreceptor drum repels. It is this bias voltage that is at the very core of the main problems that are solved in this invention.

It is the continuity of the bias voltage that is the heart of the described prior art as well as an embodiment of this invention. For example, the conductive grease helped prevent the bias voltage discontinuity. The coil spring and kits, as well as the clip, did the same. However, a simpler, more effective (and easier to install without tools that set the distance) bias voltage connector is needed.

Copending application Ser. No. 08/333,128, filed Nov. 1, 1994, in one of its various solutions to the problem, replaced the described helical spring and replacement coil spring assembly with what was basically a thick metal ring. The thick metal ring was inserted tightly between a stop formed by a change in the inside diameter of the developer roller and the electrical contact mounted on the toner cartridge. This was an excellent solution. But not all types of developer rollers have this stop, and different styles of toner cartridges have different electrical contacts. These different developer rollers and cartridge electrical contacts require something more than a thick metal ring to provide a reliable electrical connection. There is a need for more universal, dependable developer roller contact devices.

SUMMARY OF THE INVENTION

Accordingly, it is an object of this invention to provide a more reliable contact device to ensure transmission of the bias voltage from the printer, copier or facsimile machine to the developer roller.

A further object of this invention is to provide a contact device which has greater, more dependable connection with both the developer roller and the electrical contact within the toner hopper assembly.

Another object of this invention is to provide a developer roller contact device which can be used nearly universally in the LX, PX, BX, SX and NX style toner hoppers.

Still another object of this invention is to provide a developer roller contact device which is specifically designed for use in the EX style toner hopper.

In carrying out this invention in the illustrative embodiment thereof, a conductive cylindrical member with a rim on one end is inserted into a developer roller until the rim abuts against the end of the roller. The outer diameter of the cylindrical member contacts the inner wall of the developer roller. The cylindrical member has an interior which includes a contact surface that presses against the face of the washer of the electrical contact in the LX, SX, PX and NX style toner hoppers, completing the electrical circuit and allowing a bias voltage to be supplied to the developer roller. Conductive grease may be applied on the contact surface or washer face to further improve electrical connection, and the outer diameter of the cylindrical member optionally may be adhered to the inner wall of the developer roller with conductive glue.

A second embodiment of the developer roller contact device is designed for the EX style toner hopper. This embodiment also comprises a conductive cylindrical member, but the member is divided into a large diameter portion for snugly fitting into the developer roller and a small diameter portion for extending through an alignment piece on the toner hopper assembly. A coil spring is compressed between the end of the small diameter portion and the electrical contact mounted on the assembly to complete the connection and allow a bias voltage to be supplied to the developer roller.

BRIEF DESCRIPTION OF THE DRAWINGS

This invention, together with other objects, features, aspects, and advantages thereof, will be more clearly understood from the following description, considered in conjunction with the accompanying drawings.

FIG. 3 shows a prior art developer roller contact device.

FIG. 4 shows an alternative prior art developer roller contact device.

FIG. 9*a* is an enlarged view of the endcap and contact plate.

FIG. 10 is an enlarged illustration of the prior art developer roller contact device.

FIG. 11 is a side view of the second embodiment of the developer roller contact device of this invention.

FIG. 12 is an end view of the second embodiment of the developer roller contact device of this invention.

FIG. 13 shows the interior of the contact device.

FIG. 14 is a cutaway view illustrating how the contact device connects with the developer roller, alignment piece, and contact plate.

COMPLETE DESCRIPTION OF THE PREFERRED EMBODIMENT

Figure 1:
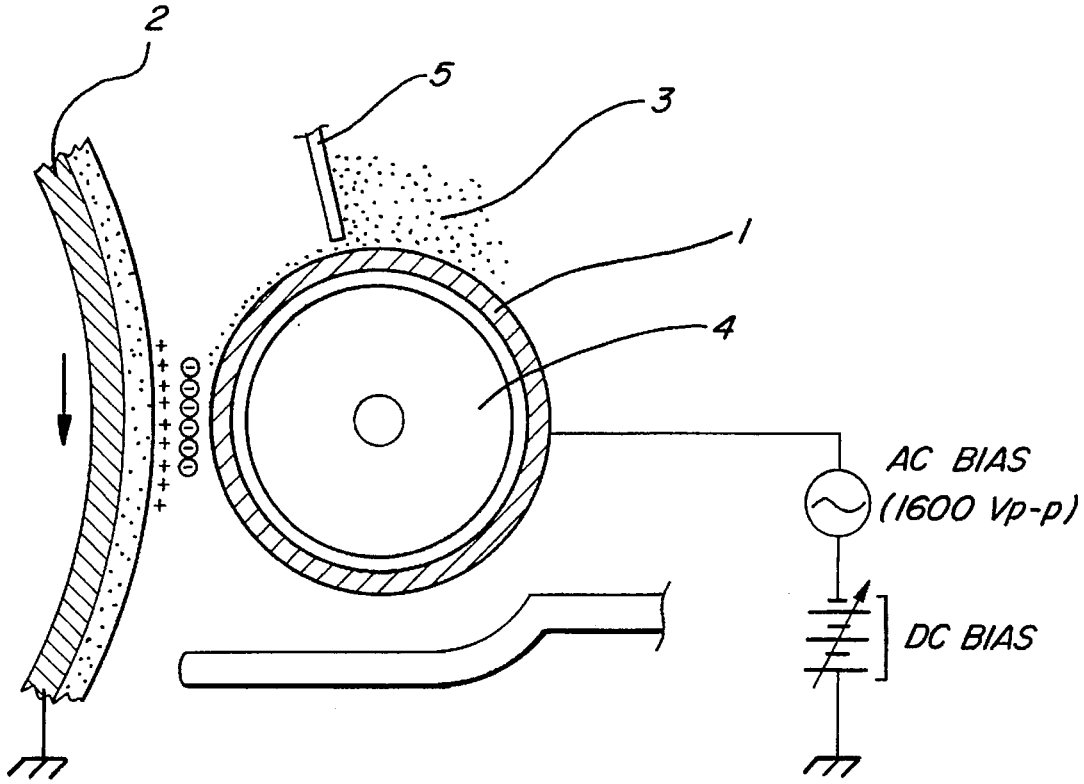
FIG - 1 PRIOR ART
FIG. 1 is a broad illustration of how the image is developed in the electrophotographic process.

FIG. 1 is meant to illustrate, in a simple manner, how an image is developed in the electrophotographic process. Toner is attracted from a developer roller 1 to a photoreceptor drum 2. The toner 3 is composed of black plastic resin bound to iron particles. The developer roller 1 has a magnetic core 4 so the toner particles are attracted to it. As the roller 1 rotates with toner 3 on it, a doctor blade 5 controls the thickness of toner on the surface of the developer roller 1. The plastic toner particles receive a negative surface charge by rubbing against the developer roller because the roller 1 is connected to a DC supply. The electrostatic charge on the particles attracts the toner 3 particles to uncharged portions of the photoreceptor drum 2 that have removed charge from prior exposure to pixels of light. The charged areas of the photoreceptor drum 2 repel the toner particles. An AC potential on the developer roller 1 helps move the toner 3 to the photoreceptor drum 2 at the desired uncharged areas yet helps toner come back to the developer roller 1 from charged areas of the drum 2 to improve density and contrast because of the AC charge alternates. The photoreceptor drum 2 provides the toner image to the output paper of the copier, printer or facsimile machine.

Figure 2:
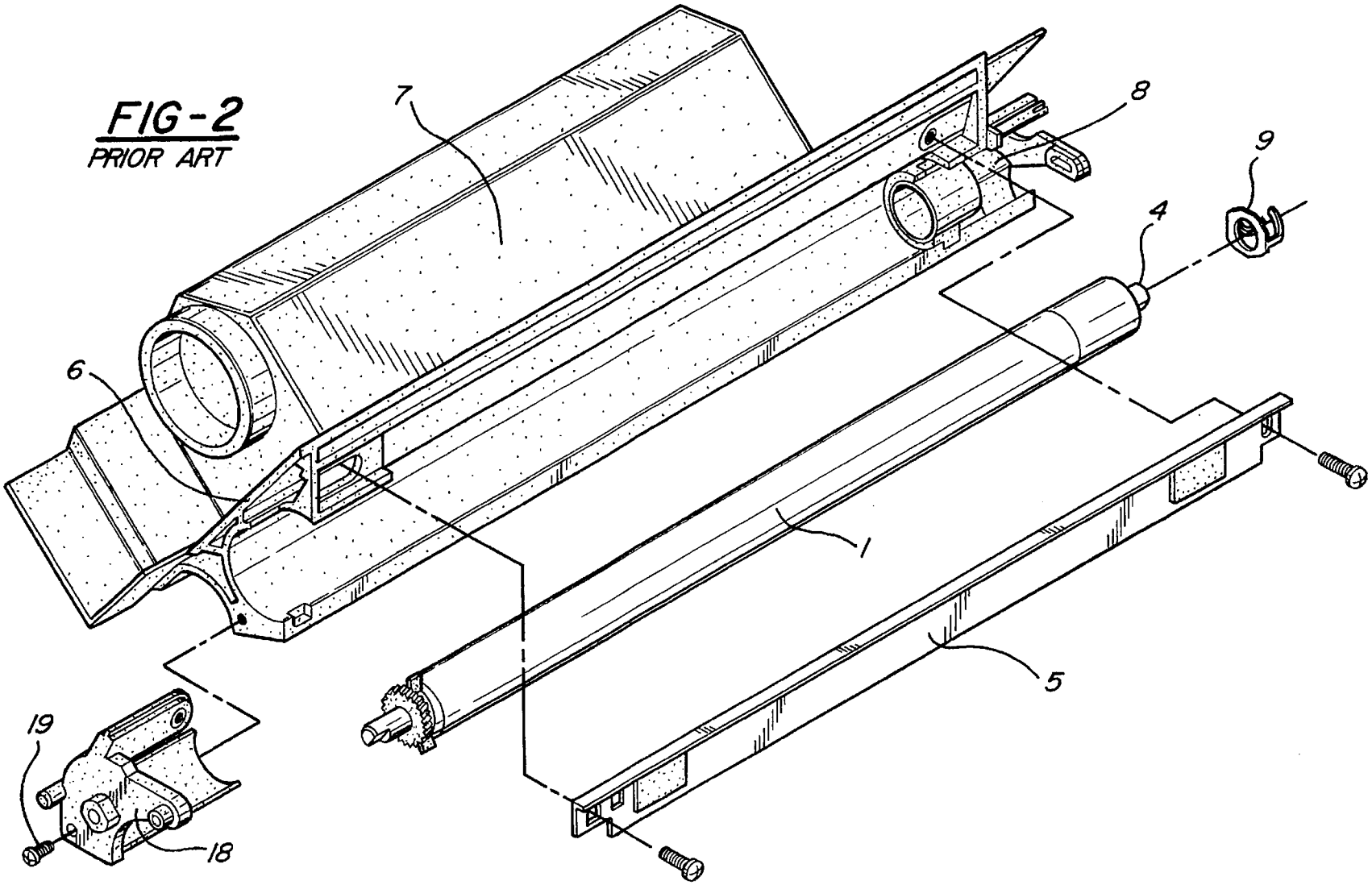
FIG-2 PRIOR ART
FIG. 2 shows a conventional toner hopper assembly.

To perform its function, the developer roller 1 has to be provided with a bias voltage. As shown in prior art FIG. 2, the developer roller 1 is part of a toner hopper assembly 6 which also includes the doctor blade 5, the toner reservoir 7, and the photoreceptor drum (not shown), as well as other components. A developer roller contact device is typically used to supply a bias voltage to the inner wall of the developer roller 1. The printer's (for example) electronic circuitry is connected to the toner hopper assembly 6 through a printer electrical contact 8 mounted on the assembly. In FIG. 2, the developer roller contact device is in the form of a helical spring 9, which is more clearly shown in prior art FIG. 3. The helical spring 9 electrically connects the inner wall 10 of the developer roller 1 with the printer electrical contact 8. The helical spring 9 has an opening 11 through it which allows the helical spring 9 to fit around the magnetic core's shaft 4 of the developer roller 1. The helical spring 9 includes four little catches 12 which cut into the inner wall 10 of the developer roller 1, while spring extensions 13 press against the printer electrical contact 8, allowing the stationary printer electronic circuitry to provide a bias voltage to the rotating developer roller 1.

Prior art FIG. 4 shows a conventional developer roller contact device sometimes used to replace the helical spring 9. A metal ring 14 has catches 15 for cutting into the inner wall 10 of the developer 1. A coil spring 16 keeps the ring 14 in the developer roller 1 while pressing a metal washer 17 against the printer electrical contact 8

As shown in FIG. 2, an endpiece or endcap 18 secures the other end of the developer roller 1 (opposite the printer electrical contact 8) to the toner hopper assembly 6. The screw 19, besides attaching the endcap 18 to the toner hopper assembly 6, can be used to adjust the tension or force of contact between the developer roller contact device and the printer electrical contact 8.

Both the helical spring 9 and metal ring 14 rotate with the developer roller 1. The developer roller contact devices, both the helical spring 9 and the replacement assembly comprising the ring 14, coil spring 16 and washer 17, eventually fail to provide reliable electrical connection. This is discussed in more detail in the Background of the Invention. Among other defects associated with these prior art contact devices, the catches 12 and 15 may wear and separate and lose contact from the inner wall 10 of the developer roller 1, and the springs 9 and 16 may lose their resilience.

Copending application Ser. No. 08/333,128, filed Nov. 1, 1994, disclosed an improved developer roller contact device basically comprising a thick metal ring which was sandwiched between a stop formed by a change in the inside diameter of the developer roller 1 wall 10 and the printer electrical contact 8. But in the SX variety toner hopper, by far the majority of toner hopper as of the date of this filing (at least fifty million such toner hopper have been made), many of the developer rollers 1 do not have the inside wall 10 diameter stop to set the position of the contact device. The developer roller contact device comprising the thick metal ring is not usable without the stop to set its position and provide extra surface contact, as described in the copending application. As a result, not all SX and NX developer rollers 1 may be improved with the invention of the copending application. Furthermore, none of the developer rollers 1 of the LX toner hopper have the stop within the developer roller. A reliable developer roller contact device had to be designed for developer rollers 1 of this different style, encompassing all LX, PX, BX and some SX and NX toner hoppers.

Figure 5:
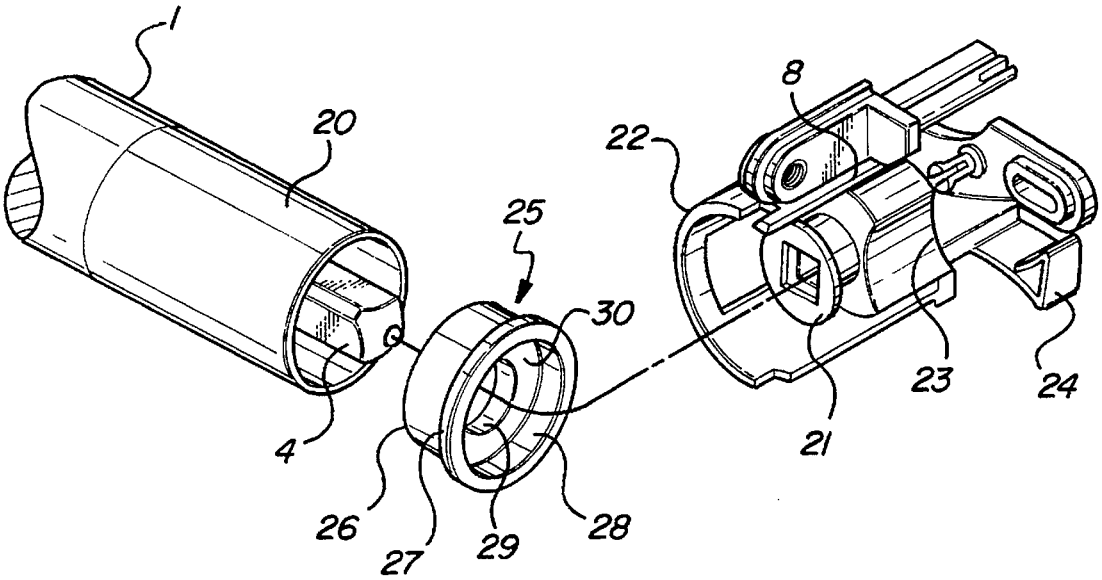
FIG. 5 illustrates a first embodiment of the developer roller contact device of this invention with the roller and printer contact.

FIG. 5 illustrates a first embodiment of the improved developer roller contact device of this invention, and also shows the printer electrical contact 8 in more detail. The conventional printer electrical contact 8 will be described first so the entire connection can be more clearly understood. The developer roller 1 has an end 20. The printer electrical contact 8 includes a stainless steel washer 21 in a plastic cap 22. The plastic cap 22 receives the end 20 of the developer roller 1 and the washer 21 receives the protruding end of the magnetic core's shaft 4. The end 20 of the roller 1 slides over the washer 21. The washer 21 is connected to the bias voltage source through the printer electrical contact 8. The washer 21 is extended in a one piece assembly 23 to the projection 24 which connects with the printer's electronic circuitry.

Figure 6:
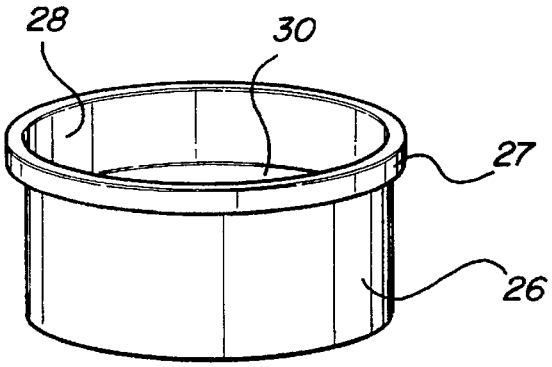
FIG. 6 is an enlarged view of the developer roller contact device.

The developer roller contact device 25, as illustrated in FIGS. 5 and 6, comprises a smooth cylindrical member 26 with a rim 27. The cylindrical member 26 has an outside diameter sized to snugly fit inside the end 20 of the developer roller 1. The rim 27 is sized to abut against the end 20 of the developer roller 1 when the cylindrical member 26 is completely inserted within the developer roller 1. The interior of the contact device 25 has two portions. The first portion 28, adjacent the rim end of the contact device 25, has an inside diameter sized to slide over the washer 21 in the printer electrical contact 8. The second portion 29 has an inside diameter sized to fit around the end of the magnetic core's shaft 4 within the developer roller 1. A contact surface 30 is formed where the interior portions 28 and 29 meet. The contact surface 30 remains in contact with and rubs against the face of the washer 21 in the printer electrical contact 8 when the developer roller contact device 25 rotates with the developer roller 1.

It has been found that the developer roller contact device 25 works well, fitting by snugness without adhesive. However, it has been tested using adhesive to adhere the contact device 25 within the end 20 of the developer roller 1, and there was no ill effect. So in developer rollers 1 with slightly larger inside diameters, glue including conductive glue) may be used to ensure the connection. With the developer roller contact device 25, electrical contact with the developer roller 1 is maintained not only where the rim 27 abuts against the end 20 of the roller 1, but also where the cylindrical member 26 touches the inner wall 10 of the roller 1.

The developer roller contact device 25 may be made of any metal. Steel is the least expensive to manufacture, but brass has corrosion resistance. Conductive plastic may also be used for the contact device 25.

Figure 7:
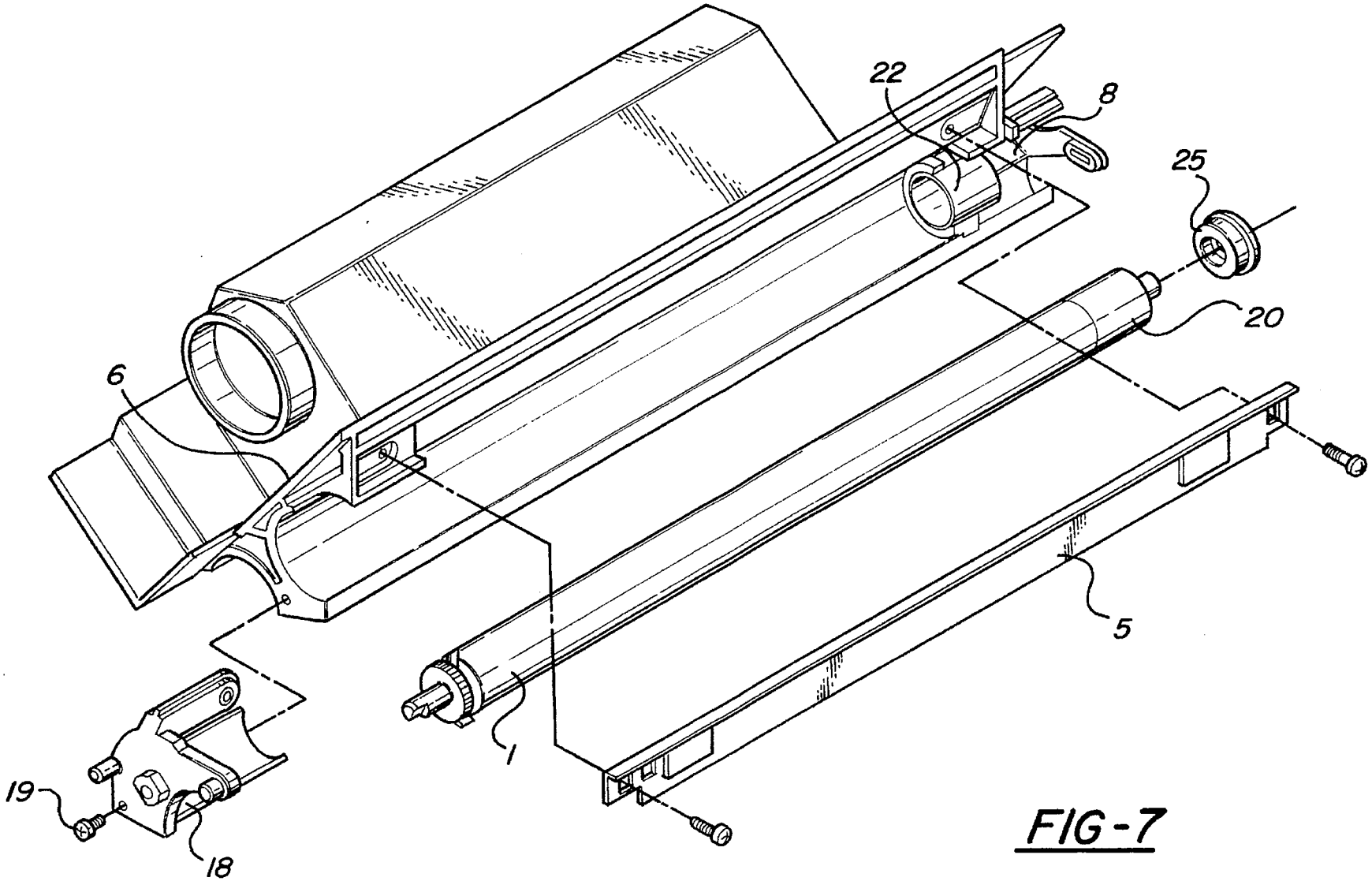
FIG. 7 shows how the contact device is connected with components on the toner hopper assembly.

As broadly illustrated by FIG. 7, the developer roller contact device 25 is inserted into the end 20 of the developer roller 1. Then the developer roller end 20 is slid into the plastic cap 22 of the printer electrical contact 8 and secured to and adjusted in position on the toner hopper assembly 6 by endcap 18 and screw 19. Finally, the doctor blade 5 is attached to the toner hopper assembly 6 over the developer roller 1. It has been found that to optimize performance of the developer roller contact device 25 two things are recommended. First, the washer 21 of the assembly 23 of the printer contact device 8 should be pulled out or bent slightly or inelastically deformed so as to always maintain spring force or resilience. This will ensure better contact as it rotates. Second, a tiny dab of conductive grease or silicone grease should be placed on the washer 21 of the printer contact device 8 where it presses against the contact surface 30 (or on the contact surface 30 itself) of the developer roller contact device 25 to improve electrical contact, to lubricate and prevent squeaking, to prevent moisture from getting on the surface of the metal, and to prevent oxidation or corrosion.

The developer rollers 1 of the LX, SX and NX toner hoppers are all approximately the same diameter with a slight tolerance difference. As a result, when the new contact device 25 was developed, it was found that the device fit well in some developer rollers 1 and was too tight in others. The tolerance was around four thousandths of an inch. As a result, in order to make such a device that is universal to all of these developer rollers, it had to be smaller than the smallest inner diameter developer roller. Consequently, the smallest inner diameter of the developer rollers 1 was set to be the maximum size of the outer diameter of the cylindrical member 26. Furthermore, it was found that this device would also work well in the other developer rollers of larger diameter that have the inside stop. So, this device is truly universal, but it does not obsolete the contact device of copending application Ser. No. 08/333,128, because that contact device is less expensive to manufacture. So the toner cartridge remanufacturer would be better off using the less expensive contact for the developer rollers with the stop and the contact device 25 for those rollers 1 that do not have the stop or shoulder. Also, most of the aftermarket developer rollers 1 do not have the stop because the developer roller 1 is less expensive to manufacture without the stop. Boring the second diameter hole in the developer roller is an extra operation in manufacturing and therefore an extra expense.

Dimensions of the developer roller contact device 25 have been determined for optimum performance and universal use. Tolerence of the OEM components varied in the developer roller 1 inside diameter considerably by +/−0.005 inch when measuring many random developer roller 1 aluminum sleeve tubes. Thus, the design was optimized so that the cylindrical member 26 is 0.250+/−0.005 of an inch long and 0.562+/−0.002 of an inch in outside diameter. The rim 27 is 0.020+/−0.005 of an inch long and 0.630+/−0.005 of an inch in outside diameter. The inside diameter of the first portion 28 of the interior of the contact device 25 is 0.500+/− of an inch. The first portion 28 extends into the interior a distance of 0.150+/−0.005 of an inch. The inside diameter of the second portion 29 of the interior of the contact device is 0.340+/−0.010 of an inch.

Figure 8:
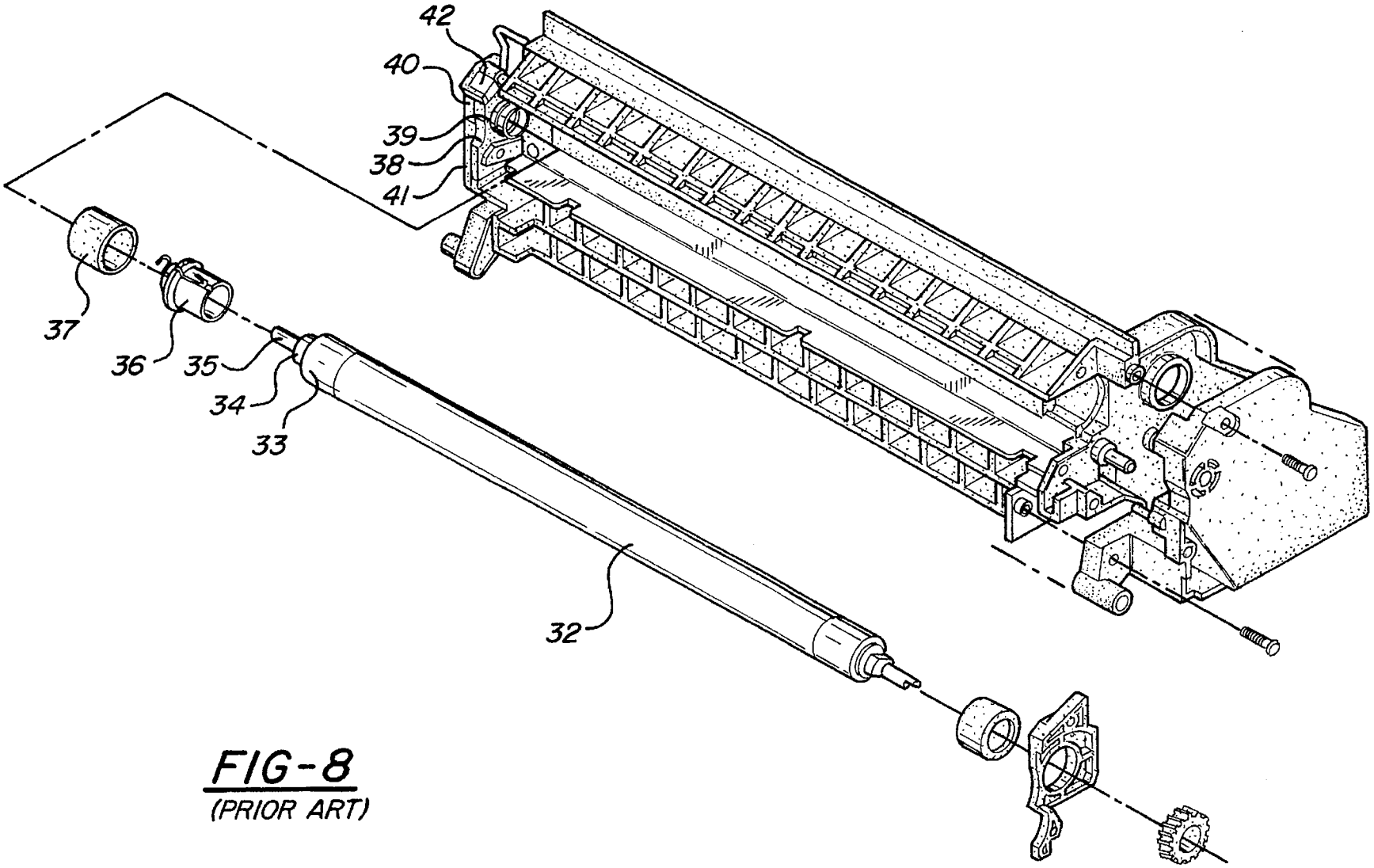
FIG-8 (PRIOR ART)
FIG. 8 shows a second type of conventional toner hopper assembly.

The contact device 25 and the contact device of the copending application Ser. No. 08/333,128 would not improve the operation of the developer roller of the EX toner hopper used in the HP Laserjet Series Four printer. FIG. 8 is a broad illustration of the EX toner hopper used in the HP Laserjet Series Four printer. FIG. 8 is a broad illustration of the EX toner hopper assembly 31. The developer roller 32 has an end 33 from which the magnetic core 34 and magnetic core shaft 35 extend. The developer roller contact device 36 fits into the end 33 of the developer roller 32. A white plastic insulative bushing 37 fits over the end 33 of the roller 32 and the contact device 36. An insulative alignment piece 38 with an opening 39 aligns the entire connection relative to the metal contact plate 40 mounted on the endcap 41 of the toner hopper assembly 31. The metal contact plate 40 connects the contact device 36 with a printer contact 42, which in turn connects with the printer's electronic circuitry.

Figure 9:
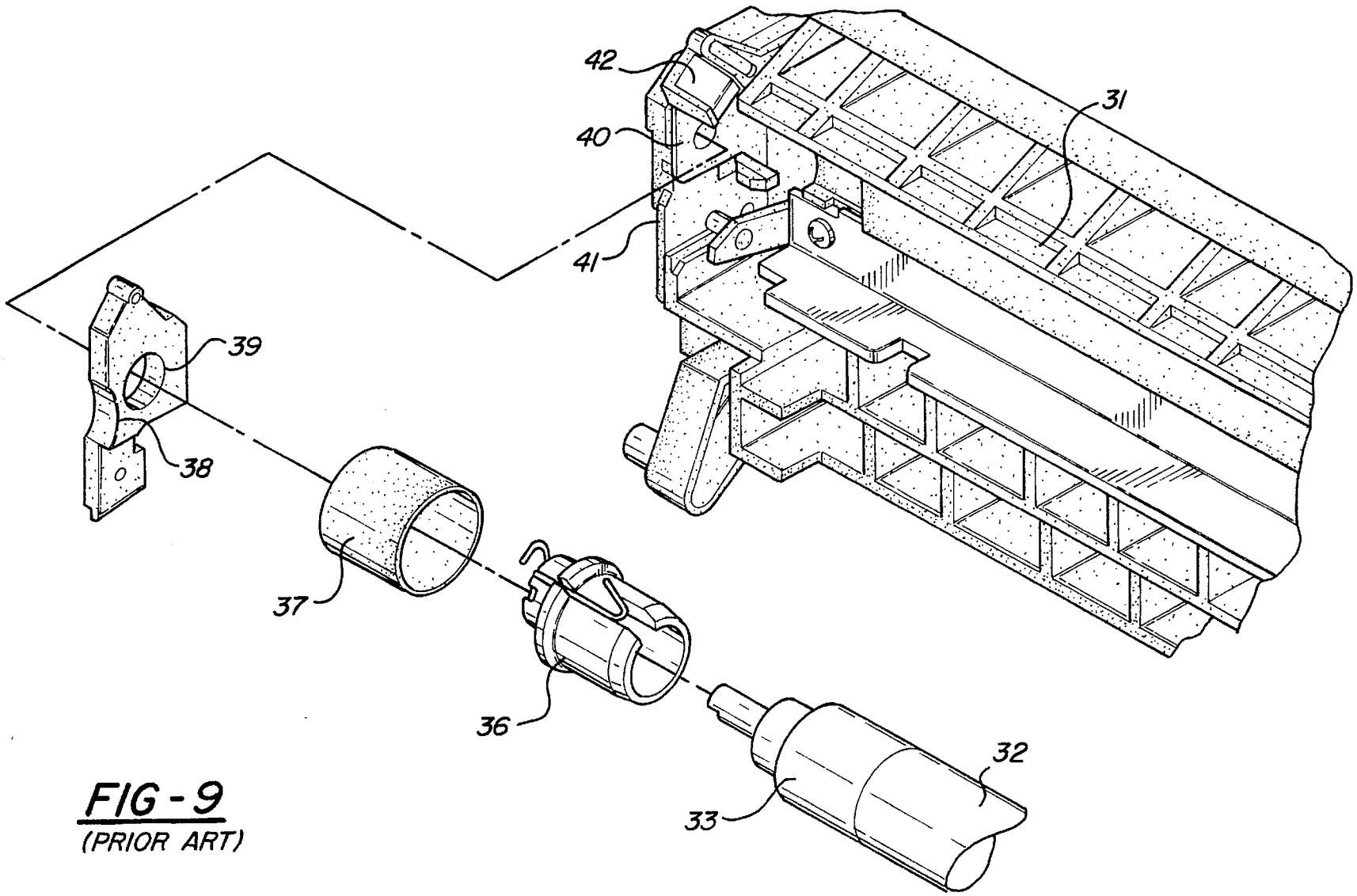
FIG-9 (PRIOR ART)
FIG. 9 is an enlarged view of the electrical contact end of the hopper assembly.

Prior art FIG. 9 is an enlarged view of the relevant end of the EX toner hopper assembly 31. The insulative alignment piece 38 is shown separated from the assembly 31. The opening 39 receives the smaller diameter portion of the contact device 36. FIG. 9*a* illustrates how the endcap 41 and contact plate 40 are modular from the toner hopper assembly 31. In other words they are removable for cleaning purposes and for putting conductive grease on the metal contact plate 40. An enlarged view of the conventional contact device 36 is shown in FIG. 10. The contact device 36 has a smaller diameter portion 43 and a larger diameter portion 44. The larger diameter portion 44 fits inside the developer roller end 33. A spring wire 45 has a developer roller contact segment 46 and a segment 47 which presses against the metal contact plate 40, completing the electric circuit. The contact device 36, except for the spring wire 45, is made of white insulative plastic.

This is a very poor bias voltage contact system. It is a pitiful system resulting in poor contact. As a result of the poor contact, the printed image lacks quality after the spring wire 45 loses its resiliency. The more the contact device 36 is used, the worse the image gets. Many toner cartridge technicians feel that the problem results from the developer roller aging. Although the aged surface of the developer roller may be a contributing factor, and it may vary on a case by case analysis, by far the largest contributing factor is the deterioration of the wire 45. It loses its resiliency, oxidizes slightly, and wears. The worst factor, however, is the loss of resiliency, which affects contact in two ways, one at each end of the spring wire 45. For example, the contact from the segment 47 to the metal contact plate 40 is poor in the first place because the wire is thin and also there is not a lot of spring wire surface area to contact. Consequently it is an accident waiting to happen. As the spring wire 45 loses its resiliency in time, it loses its contact effectiveness in time. The same is true at the segment 46 where the spring wire 45 contacts the inner wall of the developer roller 32. As time passes and more print cycles are done, the spring wire 45 loses its resiliency and the integrity of the contact of the spring wire 45 to the inner wall of the developer roller 32 is detrimentally affected to the point where the print quality of the image degrades.

The contact device 36, and thus the spring wire 45, rotate with the developer roller 32. So the segment 47 of the spring wire 45 moves relative to the metal contact plate 40. The mechanical motion makes the sring wire 45 even more prone to loss of resiliency, oxidation and wear at segment 47.

These problems led to the development of the second embodiment of this invention, an improvement of the contact device for use in the EX toner hopper assembly 31. FIGS. 11 and 12 show side and end views, respectively, of the new developer roller contact device 48, designed for the EX toner hopper. The contact device 48 comprises a metal (or conductive plastic) bushing with a large diameter portion 49 sized to fit into the end 33 of the developer roller 32. A small diameter portion 50 is sized to fit into the opening 39 in the insulative alignment piece 38. A rim 51 is formed on the large diameter portion 49 at the location where the large and small diameter portions of the contact device 48 join. The rim 51 abuts against the end 33 of the developer roller 32 when the large diameter portion 49 of the contact device 48 is completely inserted into the developer roller 32, providing additional electrical contact surface area between the contact device 48 and roller 32.

FIG. 13 shows the interior of the contact device 48. The large diameter portion 49 has an inside diameter 52 sized to fit around the magnetic core 34 of the roller 32. The small diameter portion 50 has an inside diameter 53 sized to fit around the magnetic core shaft 35 extending from the magnetic core 34. The taper where the two inner diameters 52 and 53 join is not essential, but is a function of the tool used to make the prototype. In actual manufacture, the two inside diameters 52 and 53 will usually join directly, without the taper.

FIG. 14 is a cutaway view of the contact device 48 and selected components of the toner hopper assembly 31, as they would appear when connected. The magnetic core shaft 35 extends through the contact device 48, insulative alignment piece 38, metal contact plate 40 and endcap 41 of the toner hopper assembly 31. The small diameter portion 50 of the contact device 48 fits into the opening 39 in the insulative alignment piece 38. The insulative plastic bushing 37 covers the end 33 of the developer roller 32 as well as the rim 51 and a part of the small diameter portion 50 of the contact device 48 because the tolerance in the manufacture of the OEM components has so wide a variation that the precision required of the length of the device 48 would have to vary accordingly from one toner hopper to the next. Note that a coil spring 54 is used to complete the electrical connection between the small diameter portion 50 of the contact device 48 and the metal contact plate 40. The coil spring 54 is of heavier metal than the prior art spring wire 45. This coil spring 54 is held under tight pressure to maintain improved and continued electrical contact between the developer roller contact device 48 and the metal contact plate 40. The small diameter portion 50 of the contact device 48 may be made long enough to directly contact or touch the metal contact plate 40, but it has been found that using the coil spring 54 improves the reliability and function of the contact device 48.

Figure 15:
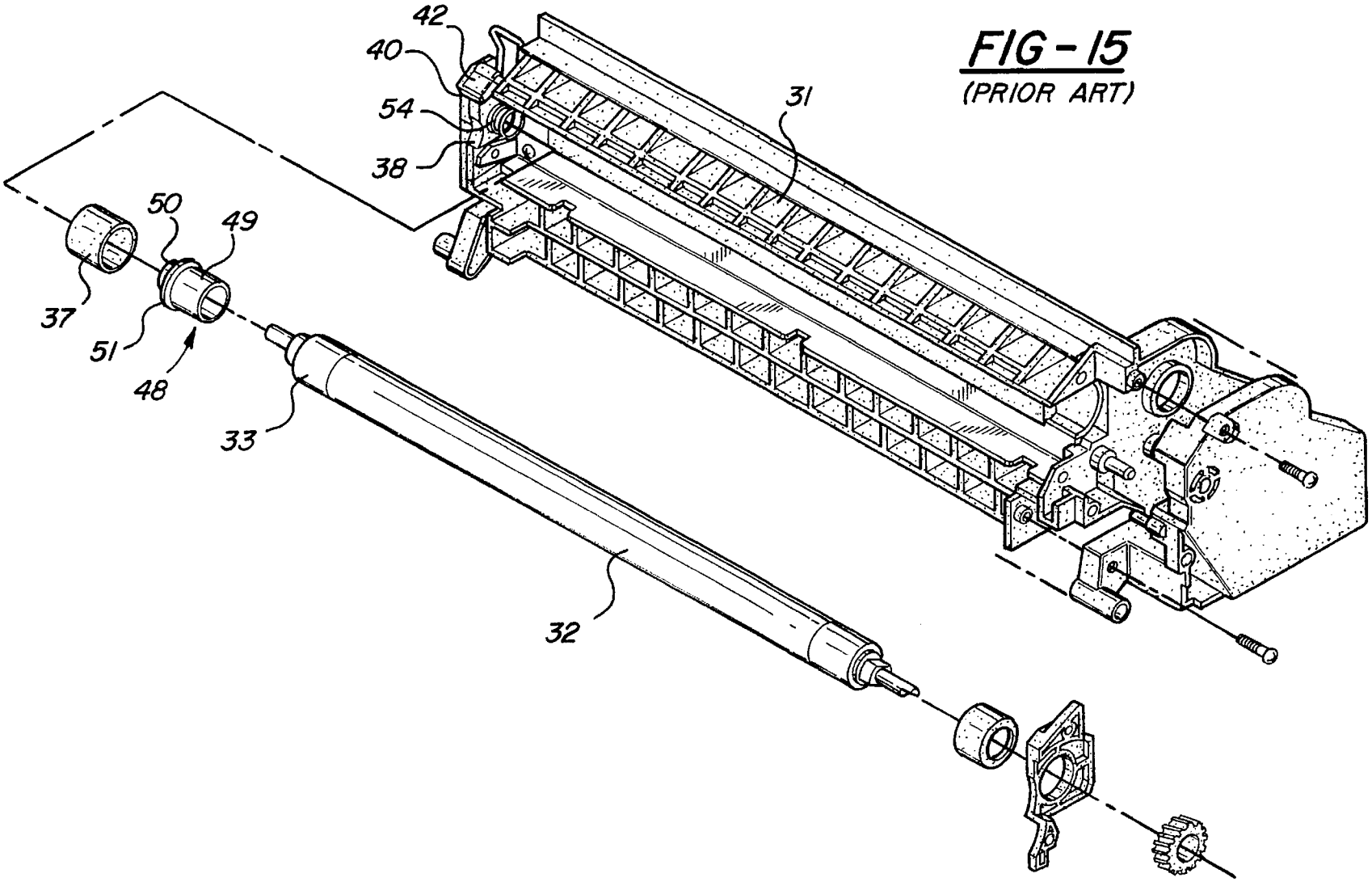
FIG-15 (PRIOR ART)
FIG. 15 shows the new contact device in combination with the components of the toner hopper assembly.
Figure 16:
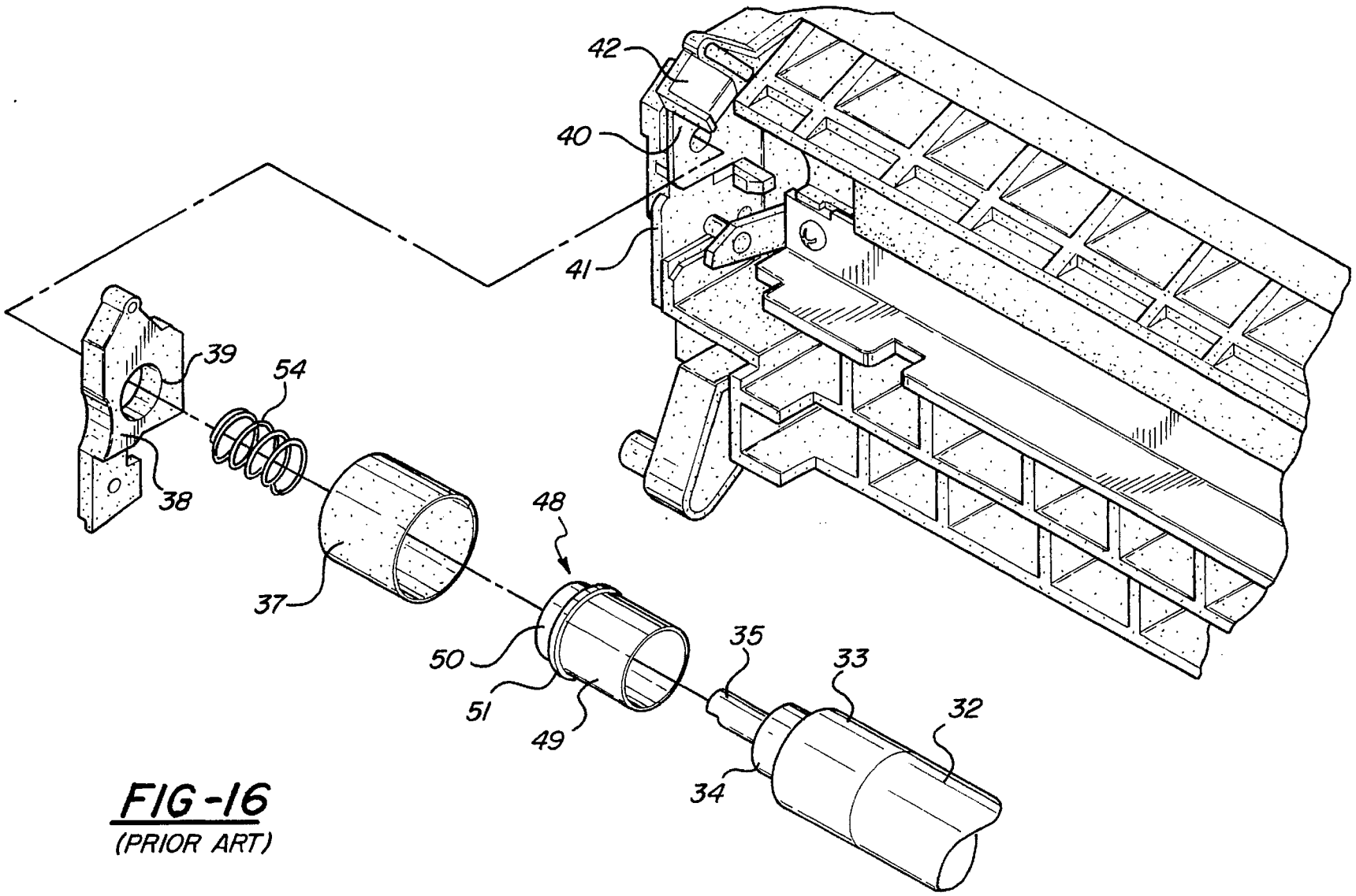
FIG-16 (PRIOR ART)
FIG. 16 is an enlarged view of the electrical contact end of the toner hopper assembly in combination with the new developer roller contact device.

FIG. 15 is a broad illustration of how the developer roller contact device 48 is connected with the toner hopper assembly 31. In one optomized design, the large diameter portion 49 is inserted into the end 33 of the roller 32, and the plastic bushing 37 slipped over the roller end 33 and contact device 48. The small diameter portion 50 is then pressed against the coil sprint 54 and into the opening 39 in the insulative alignment piece 38, and the developer roller 32 is mounted on the toner hopper assembly 31. FIG. 16 is an enlarged view of the relevant end of the toner hopper assembly 31 to more clearly show the contact device 48 connection. The alignment piece 38 and coil spring 54 are shown separated from the assembly 31 for clarity. As with the contact device 25, the outer surface of the large diameter portion 49 of the contact device 48 may be adhered by glue or conductive glue to the inner wall of the developer roller 32.

The dimensions of the developer roller contact device 48 for the EX toner hopper assembly 31 were determined for optimum performance in combination with the coil spring 54. The large diameter portion 49 is 0.560+/−0.002 of an inch in outside diameter and 0.500+/−0.015 of an inch long. The rim 51 is 0.035+/−0.010 of an inch long and has an outside diameter of approximately 0.625 of an inch. The small diameter portion 50 is approximately 0.430 of an inch in outside diameter and approximately 0.150 of an inch long. The inside diameter 52 of the large diameter portion 49 is 0.450+/−0.005 of an inch, and the inside diameter 53 of the small diameter portion 50 is approximately 0.250 of an inch. By using the minimum outside diameter possible on the contact device it will thus fit in the smallest inside diameter of the developer rollers 32 taken from a sample of rollers 32. The variance in the developer rollers 32 inside diameter was around 0.004 inches. Thus with this design, the contact device 48 will fit snugly in the smaller inside diameter developer rollers 32 and will fit looser in the larger inside diameter developer rollers 32. Even the loose fit contacts function very well.

By using the contact device 48 in the EX toner hopper assembly, the integrity of image quality is improved and kept consistent. Print darkness may be maintained, gray haze background may often be prevented, and the performance of the developer roller improved.

Figure 17:
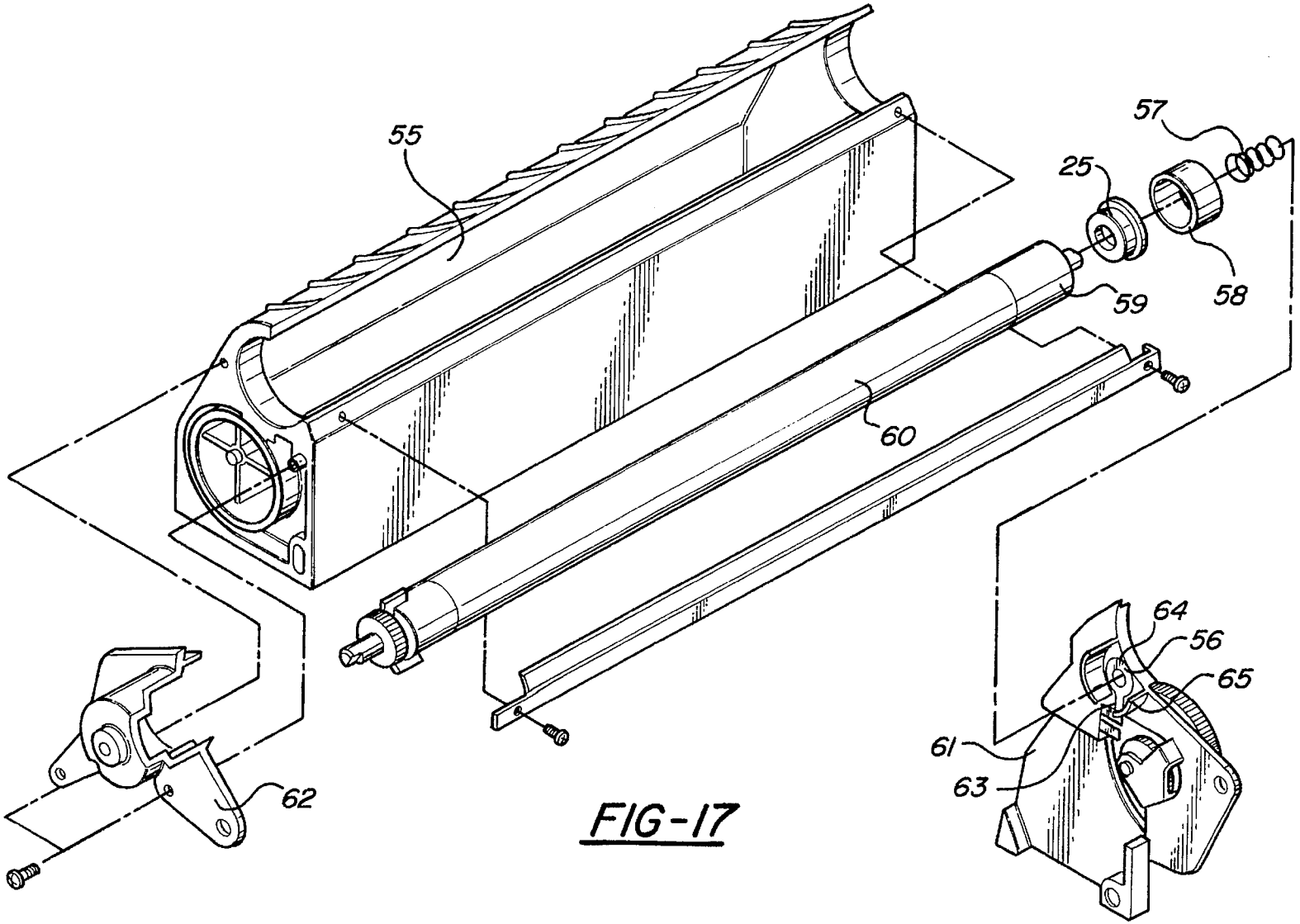
FIG. 17 shows an LX toner hopper assembly with the first embodiment of the invention in combination with a coil spring.

FIG. 17 shows the LX toner hopper assembly 55. The first embodiment of the developer roller contact device 25, as mentioned previously, may be used in this toner hopper. However, the printer electrical contact 56 is different in this toner hopper. A coil spring 57 is also needed for this toner hopper to complete the electrical connection between the developer roller contact device 25 and the printer electrical contact 56. There is an insulative plastic cap 58 which covers the end 59 of the developer roller 60 and the contact device 25. The endcap 61 containing the printer electrical contact 56 is attached to the toner hopper assembly 55 first. Then the developer roller 60 and contact device 25 are mounted on the toner hopper assembly 55. Finally, the opposite endcap 62 is attached to complete the assembly. It should be pointed out that with this embodiment of the LX toner hopper, the contact device 25 designed for the SX and NX toner hopper of the first embodiment may be identical in dimensions, interchangably. Also, the spring 54 of the second embodiment EX) may be identical to the spring 57 (LX) in this embodiment, interchangably. Thus, this third embodiment (LX, BX)is a combination of the first (SX,NX) and second (EX) embodiments.

It should also be mentioned that the small PX toner hopper has similar problems and needs. Thus, a contact device was designed for it (not shown). In the design, a smaller version of the contact 25 was used. It has a smaller diameter and is smaller in every dimension. The bore in the first portion 28 is very shallow, thus a shorter spring 57 was used, also with a smaller diameter. The endcap is similar to 61 with contact 56 slightly different, but the same design works fine when reduced in size.

The LX and PX printer electrical contacts do not have a bend at the location 65 where the stem portion 63 joins the washer section 64 like the SX printer electrical contact 21 has. That is why the spring 57 is required in this embodiment. A modified version of the EX contact device 48 may also be used (without the spring since the printer contact 56 can be slightly bent for springiness) in the LX and PX toner hoppers. In this design, the inner hole 52 (of the EX contact 48) and the other inner hole 53 would both be of the same smaller) diameter, thus it would be one hole. Thus the cost is reduced because only one hole is required and also no spring is required. Also, With this design, the small diameter portion 50 would be much shorter. In one LX design, it was around 1/32 of an inch long. Thus, with this design, it is less expensive to manufacture. One drawback, however, is that in the prototypes made thus far, although it was quite easy to install, it required tweaking the printer contact 56 to get it to function reliably. Plus (in the case of LX) the same size piece 25 fits LX and SX by taking the SX contact 25 and simply adding a spring 57, and thus there are less components to require manufacturing.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented byreasonable equivalents to the claimed elements.

What is claimed is:

1. An improved contact device for reliably providing a bias voltage to a developer roller of a toner hopper assembly, said improved contact device comprising:

a conductive cylindrical member for electrically connecting the developer roller with a electrical contact on the toner hopper assembly;

said conductive cylindrical member including an outer diameter sized to snugly fit with in the developer roller and contact an inner wall of the developer roller;

said conductive cylindrical member including an interior, a first end, and a second end; and said interior including a region adjacent said first end with an inside diameter sized to fit over the electrical contact on the toner hopper assembly.

2. An improved contact device as in claim 1 wherein said conductive cylindrical member includes a rim for abutting against an end of the developer roller when said cylindrical member is completely inserted into the developer roller.

3. An improved contact device as in claim 1 wherein the developer roller has a magnetic core, said device including:

a region in said interior adjacent said second end of said cylindrical member with an inside diameter sized to fit around the magnetic core.

4. An improved contact device as in claim 3 wherein said interior of said cylindrical member has a contact surface formed where said region adjacent said first end and said region adjacent said second end meet, whereby said contact surface presses against the electrical contact when said cylindrical member is inserted in the developer roller and the roller is mounted on the toner hopper assembly.

5. An improved contact device as in claim 4 including conductive grease on said contact surface.

6. An improved contact device as in claim 1 including conductive glue on said cylindrical member for adhering said conductive cylindrical member to the inner wall of the developer roller.

7. An improved contact device as in claim 1 wherein said conductive cylindrical member is made of metal.

8. An improved contact device as in claim 1 wherein said conductive cylindrical member is made of conductive plastic.

9. An improved contact device as in claim 1 wherein the electrical contact includes a spring and said interior of said conductive cylinderical member fits over the spring.

10. An improved contact device for reliably providing a bias voltage to a developer roller of a toner hopper assembly, said improved contact device comprising:

a conductive cylindrical member for electrically connecting the developer roller with an electrical contact on the toner hopper assembly;

said conductive cylindrical member including a large diameter portion sized to snugly fit within a hollow end portion of the developer roller and a small diameter portion sized to extend through an opening in an alignment piece on the toner cartridge assembly for connection with the electrical contact;

wherein the developer roller has a magnetic core and said large diameter portion of said conductive cylindrical member has an inside diameter sized to fit around the magnetic core.

11. An improved contact device as in claim 10 including:

a rim formed where said small diameter portion and said large diameter portion join, whereby said rim abuts against an end of the developer roller when said large diameter portion is completely inserted in the developer roller.

12. An improved contact device as in claim 10 wherein the magnetic core has a shaft extending from the core and said small diameter portion of said conductive cylindrical member has an inside diameter sized to fit around the shaft.

13. An improved contact device as in claim 10 wherein said conductive cylindrical member is made of metal.

14. An improved contact device as in claim 10 wherein said conductive cylindrical member is made of conductive plastic.

15. An improved contact device for reliably providing a bias voltage to a developer roller of a toner hopper assembly, said improved contact device comprising:

a conductive cylindrical member for electrically connecting the developer roller with an electrical contact on the toner hopper assembly;

said conductive cylindrical member including a large diameter portion sized to snugly fit within a hollow end portion of the developer roller and a small diameter portion sized to extend through an opening in an alignment piece on the toner cartridge assembly for connection with the electrical contact; and a spring for completing the connection between said small diameter portion of said conductive cylindrical member and the electrical contact on the toner cartridge assembly.

16. An improved contact device as in claim 15 wherein said cylindrical member includes a top surface adjacent said smaller diameter portion, and said spring comprises a coil spring contiguous said top surface of said cylindrical member for providing an electrical connection between said cylindrical member and the electrical contact while being held under tight pressure between said small diameter portion and the electrical contact.

17. An improved contact device for reliably providing a bias voltage to a developer roller of a toner hopper assembly, said improved contact device comprising:

a conductive cylindrical member for electrically connecting the developer roller with an electrical contact on the toner hopper assembly;

said conductive cylindrical member including an interior, a first end, and a second end;

said cylindrical member including a region in said interior adjacent said first end of said cylindrical member with an inside diameter sized to slide over the electrical contacton on the toner hopper assembly;

wherein the developer roller has a magnetic core and said device includes a region in said interior adjacent said second end of said cylindrical member with an inside diameter sized to fit around the magnetic core.

18. An improved contact device as in claim 17 wherein said conductive cylindrical member includes an outer diameter sized to snugly fit within the developer roller and contact an inner wall of the developer roller.

19. An improved contact device as in claim 18 including conductive glue on said conductive cylindrical member for adhering said cylindrical member to the inner wall of the developer roller.

20. An improved contact device as in claim 17 wherein said conductive cylindrical member includes a rim adjacent said first end of said cylindrical member for abutting against an end of the developer roller when said cylindrical member is completely inserted into the developer roller.

21. An improved contact device as in claim 17 wherein said interior of said cylindrical member has a contact surface formed where said region adjacent said first end and said region adjacent said second end meet, whereby said contact surface presses against the electrical contact when said cylindrical member is inserted in the developer roller and the roller is mounted on the toner hopper assembly.

22. An improved contact device as in claim 21 including conductive grease on said contact surface.

23. An improved contact device as in claim 17 wherein said conductive cylindrical member is made of metal.

24. An improved contact device as in claim 17 wherein said conductive cylindrical member is made of conductive plastic.

25. An improved toner cartridge comprising:

a toner hopper;

a rotatable developer roller supported by said toner hopper;

said developer roller comprising a cylindrical member including a hollow end portion;

said end portion of said developer roller including an inner surface;

an electrical contact supported on said toner hopper adjacent said end portion of said developer roller;

a conductive cylindrical member disposed within said end portion of said developer roller;

said conductive cylindrical member including an outer diameter sized to snugly fit within said developer roller and contact said inner surface of said developer roller;

said conductive cylindrical member contacting said electrical contact and forming an electrical connection between said developer roller and said electrical contact;

said conductive cylindrical member including an interior, a first end, and a second end; and said interior of said conductive cylindrical member including a region adjacent said first end with an inside diameter sized to fit over the electrical contact on the toner hopper assembly.

26. An improved toner cartridge comprising:

a toner hopper;

a rotatable developer roller supported by said toner hopper;

said developer roller comprising a cylindrical member including a hollow end portion said end portion of said developer roller including an inner surface;

an electrical contact supported on said toner hopper adjacent said end potion of said developer roller;

a conductive cylindrical member disposed within said end portion of said developer roller;

said conductive cylindrical member contacting said electrical contact and forming an electrical connection between said developer roller and said electrical contact;

said conductive cylindrical member including an interior, a first end, and a second end;

said conductive cylindrical member including a region in said interior adjacent said first end of said cylindrical member having an inner surface in snug contact with an outer peripheral surface of said electrical contact;

said developer roller including a magnetic core;

said conductive cylindrical member including a region in said interior adjacent said second end of said cylindrical member surrounding said magnetic core.

27. An improved toner cartridge comprising:

a toner hopper;

a rotatable developer roller supported by said toner hopper;

said developer roller comprising a cylindrical member including a hollow end portion;

said end portion of said developer roller including an outer surface and an inner surface;

an electrical contact supported on said toner hopper adjacent said end portion of said developer roller;

a conductive cylindrical member disposed within said end portion of said developer roller;

said conductive cylindrical member contacting said electrical contact and forming an electrical connection between said developer roller and said electrical contact;

said conductive cylindrical member including a large diameter portion in snug contact with said inner surface of said end portion;

said conductive cylindrical member including a small diameter portion electrically connected with said electrical contact and sized to extend through an opening in an alignment piece on said toner cartridge assembly;

said developer roller including a magnetic core; and said large diameter portion of said conductive cylindrical member including an inside diameter sized to fit around the magnetic core.

28. An improved toner cartridge comprising:

a toner hopper;

a rotatable developer roller supported by said toner hopper;

said developer roller comprising a cylindrical member including a hollow end portion;

said end portion of said developer roller including an outer surface and an inner surface;

an electrical contact supported on said toner hopper adjacent said end portion of said developer roller;

a conductive cylindrical member disposed within said end portion of said developer roller;

said conductive cylindrical member contacting said electrical contact and forming an electrical connection between said developer roller and said electrical contact;

said conductive cylindrical member including a large diameter portion in snug contact with said inner surface of said end portion;

said conductive cylindrical member including a small diameter portion electrically connected with said electrical contact and sized to extend through an opening in an alignment piece on said toner cartridge assembly; and a spring connecting said small diameter portion of said conductive cylindrical member and said electrical contact.

* * * * *